US007861960B2

(12) United States Patent
Bhide

(10) Patent No.: US 7,861,960 B2
(45) Date of Patent: Jan. 4, 2011

(54) INSTALLATION OF LINERS IN A TUBE MILL, TUBE MILL PROVIDED WITH LINERS

(75) Inventor: S. V. Bhide, Maharashtra (IN)

(73) Assignee: AIA Engineering Ltd., Ahmedabad (IN)

( * ) Notice: Subject to any disclaimer, the term of this patent is extended or adjusted under 35 U.S.C. 154(b) by 137 days.

(21) Appl. No.: 12/112,882

(22) Filed: Apr. 30, 2008

(65) Prior Publication Data

US 2008/0302896 A1 Dec. 11, 2008

(30) Foreign Application Priority Data

May 2, 2007 (IN) ..... 860MUM2007

(51) Int. Cl.
*B02C 17/22* (2006.01)

(52) U.S. Cl. ..... 241/299; 241/182; 241/300

(58) Field of Classification Search ..... 241/182, 241/183, 299, 300, DIG. 30; 29/402.03, 29/428, 525.01
See application file for complete search history.

(56) References Cited

U.S. PATENT DOCUMENTS 1,174,160 A * 3/1916 Jensen ..... 241/183
2,216,784 A * 10/1940 Payne ..... 29/525.14

* cited by examiner

*Primary Examiner*—Mark Rosenbaum
(74) *Attorney, Agent, or Firm*—Townsend and Townsend and Crew LLP

(57) ABSTRACT

A tube mill is provided with liners fastened to a shell. The tube mill is provided with an adaptor plate. The adaptor plate is provided with a first pattern of drilling holes in a DIN pattern and a second pattern of drilling holes in a non-DIN pattern. The adaptor plate is fastened to the shell via one or more holes of the second pattern and a number of liners is fastened to the adaptor plate via one or more holes of the first pattern.

14 Claims, 4 Drawing Sheets

INSTALLATION OF LINERS IN A TUBE MILL, TUBE MILL PROVIDED WITH LINERS

CROSS-REFERENCES TO RELATED APPLICATIONS

This application claims priority to Indian application No. 860MUM2007, filed on May 2, 2007.

BACKGROUND

The invention relates to a tube mill provided with liners fastened to a shell. The invention also relates to a method for installing liners in a tube mill.

A large number of tube mills used for grinding and pulverizing applications have drilling pattern with a pitch of 250 mm in longitudinal direction and 314 mm in circumferential direction. This standard has been adopted all over the world as a DIN standard. However, there are some mills, most of which are old mills, which are termed as non-DIN standard mills having drilling pattern in many different varieties. Installation of DIN standard liners in such mills posses many problems. Fitting and fastening the liners in the mill requires liners to be designed separately for each mill.

Therefore it is desirable to provide an arrangement for enabling installation of DIN standard liners of boltless configuration in non-DIN standard mills.

BRIEF SUMMARY

Various embodiments of tube mills are provided herein. Tube mills in accordance with various embodiments include an adaptor plate, the adaptor plate being provided with a first pattern of drilling holes in a DIN pattern and a second pattern of drilling holes in a non-DIN pattern, wherein the adaptor plate is fastened to the shell via one or more of the holes of the second patterns and a number of liners is fastened to the adaptor plate via one or more holes of the first pattern. A method of installation of liners in a tube mill is also provided. According to various embodiments, an adaptor plate with a first pattern of drilling holes in a DIN pattern and a second pattern of drilling holes in a non-DIN pattern is provided, liners are attached to the adapter plate via the holes of the first pattern, and the adaptor plate is attached to the shell via one or more holes of the second pattern.

The first and the second patterns may not have any hole in common. Preferably, after fixing of at least two rows of bolted liners, rows of unbolted liners are installed.

According to one embodiment, a tube mill is provided that typically includes a shell, liners fastened to the shell, and an adaptor plate having a first pattern of drilling holes in a DIN pattern and a second pattern of drilling holes in a non-DIN pattern, wherein the adaptor plate is fastened to the shell via one or more of the holes of the second patterns and a plurality of liners is fastened to the adaptor plate via one or more holes of the first pattern.

According to another embodiment, a method for installing liners in a tube mill is provided. The method typically includes providing an adaptor plate having a first pattern of drilling holes in a DIN pattern and a second pattern of drilling holes in a non-DIN pattern, attaching liners to the adapter plate via the holes of the first pattern, and attaching the adaptor plate to a shell via one or more holes of the second pattern.

Reference to the remaining portions of the specification, including the drawings and claims, will realize other features and advantages of the present invention. Further features and advantages of the present invention, as well as the structure and operation of various embodiments of the present invention, are described in detail below with respect to the accompanying drawings. In the drawings, like reference numbers indicate identical or functionally similar elements.

BRIEF DESCRIPTION OF THE DRAWINGS

These and other advantageous aspects of the invention will be described in more detail using the following figures.

The figures are not drawn to scale. Generally, identical components are denoted by the same reference numerals in the figures.

DETAILED DESCRIPTION

Tube mills used for grinding and pulverization of clinker and minerals such as limestone or coal are fitted with liners. The liners have the function of protecting the shell and of distributing the grinding media in the mill so that crushing efficiency is improved. These liners are affixed on the shell using fastening devices.

Installation of liners without use of fasteners is also common and a variety of arrangements are used. Installation of liners without fasteners has many advantages over liners installed with fasteners. Loosening/breakage of a fastener can cause displacement of a liner from its position and consequent damage in the mill. The fasteners have to be retightened at regular intervals at least at the beginning of the campaign with new liners which is not required in case of liners without fasteners. There is always chance of leakage of ground material in the case of liners with fasteners causing environmental damage. There is less chance of breakage of liners without bolt-holes. Due to these operational and process advantages, the present invention provides in one embodiment a system to install boltless liners as per DIN standard on a shell with non-DIN drilling.

Figure 1:
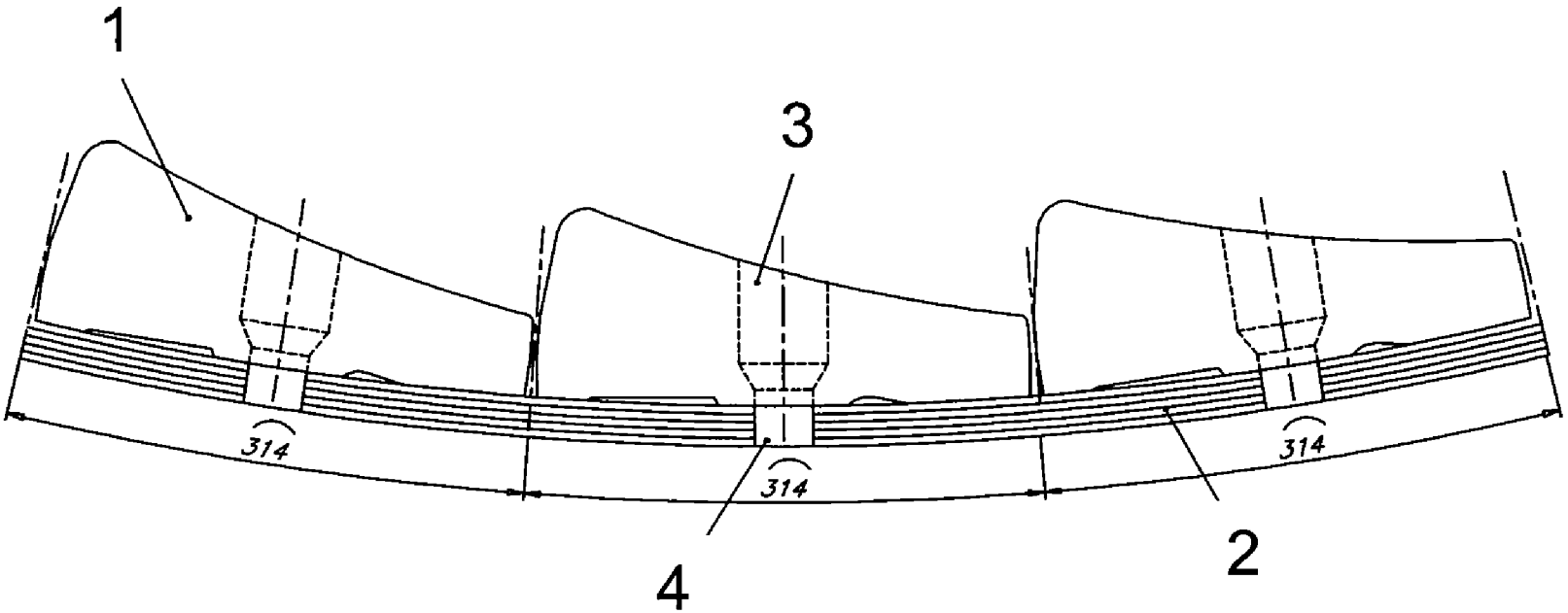
FIG. 1 illustrates a typical arrangement of a tube mill shell (2) having drilled holes (4) as per DIN standard with bolted DIN Liners (1)
Figure 2:
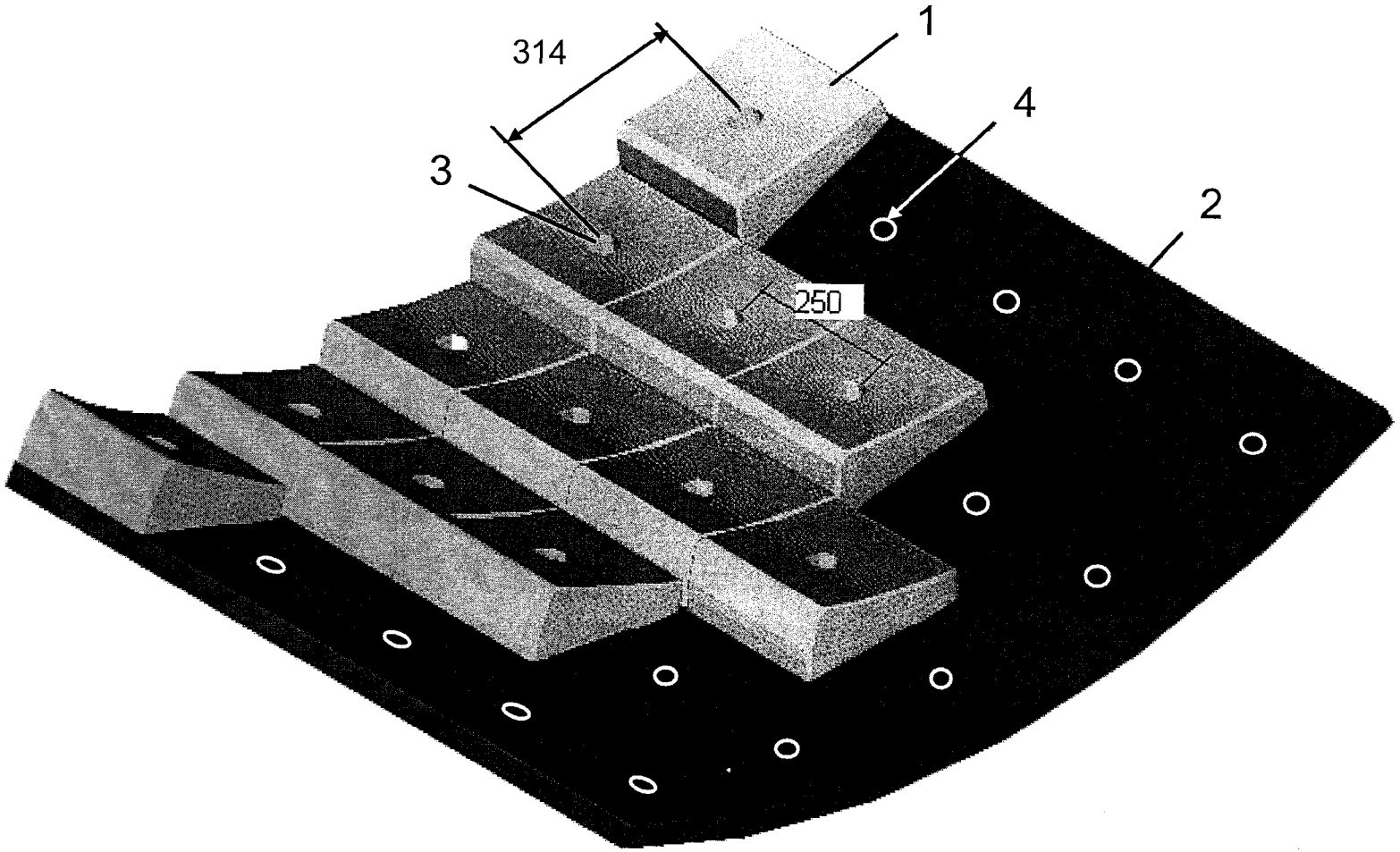
FIG. 2 provides a 3D representation of installation of DIN liners (1) in a tube mill shell (2) with drilled holes as per DIN standard (4).

FIGS. 1 and 2 illustrate a typical arrangement of DIN liners 1 on a shell 2. The shell 2 is provided with holes 4, and the liner with holes 3. Through the holes 3 in the liners 1 bolts, here not shown, are provided. In certain aspects, threaded bolts are fastened with a nut and washer from outside the shell.

In the case of DIN standard mills, installation of boltless liners is well standardized and production of boltless liners is much easier with DIN standard mills. However, liners have to be designed separately for each non-DIN standard mill depending on the radial and longitudinal pitch of the bolt holes in the shell. Embodiments of the present invention have advantageously removed this limitation. The adaptor plate provides for a convenient, easy and safe way of installing DIN-type liners in a non-DIN standard mill.

Figure 3:
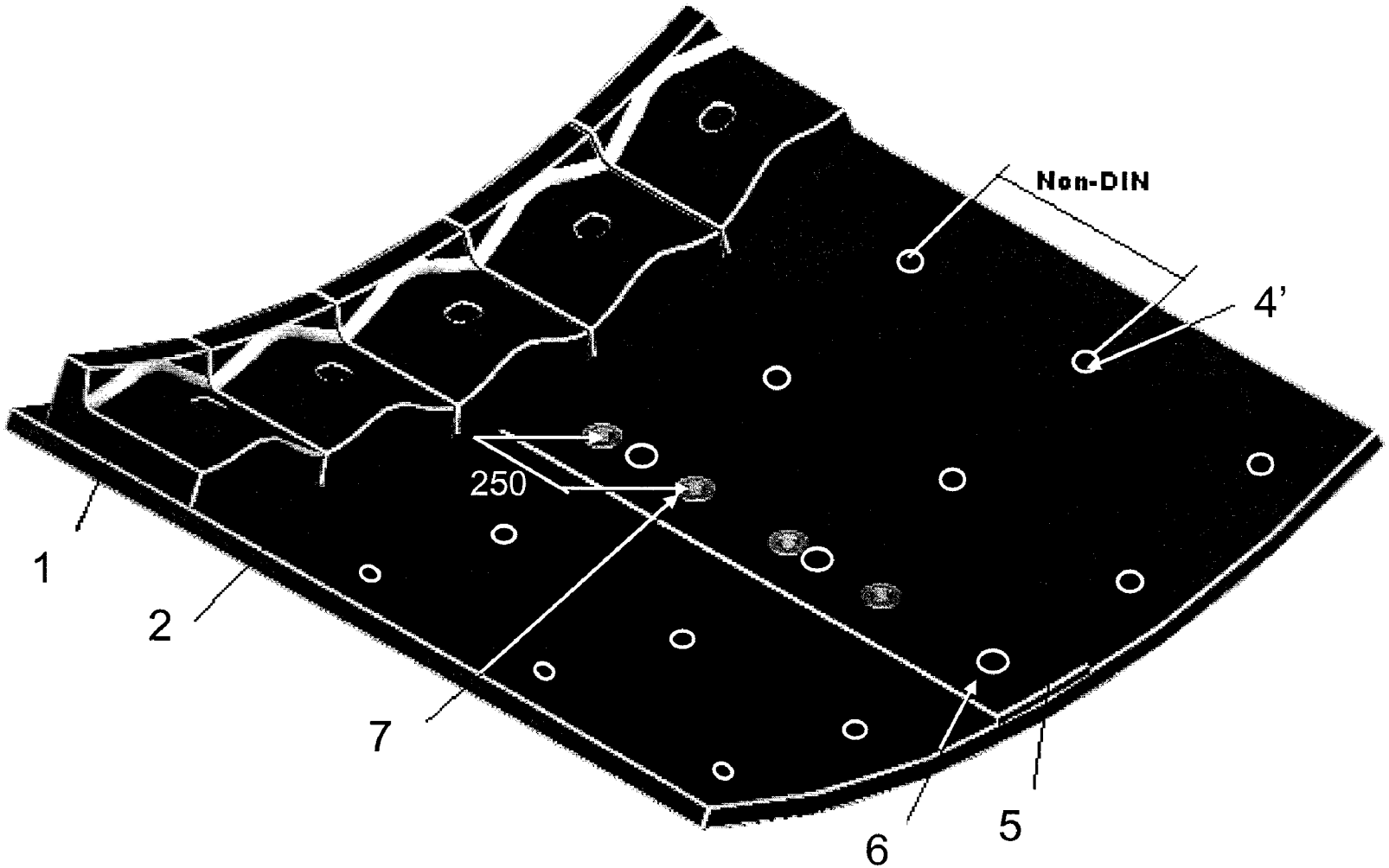
FIG. 3 illustrates a shell of a tube mill (2) provided with an adaptor plate (5) according to the invention with non-DIN holes (6) matching with the non-DIN holes of the shell and also with threaded DIN standard holes (7) to which DIN standard liners will be screwed.

According to certain aspects, installation of DIN standard boltless liners on non DIN standard shell requires installation of one bolted row each at the two ends of mill chamber in circumferential direction and at least two rows of bolted liner in longitudinal direction. An arrangement for installation of bolted rows in non-DIN mill is shown in FIG. 3. FIG. 3 shows the shell 2 of the mill with holes 4' with a pitch (e.g., of about one foot (non-metric)) in a longitudinal direction. An adaptor plate 5 is mounted on the shell and has a pattern of holes 6 with a drilling pitch (e.g., of about one foot). The plate has a second pattern of threaded hole 7 arrangement at 250 mm pitch, i.e. at DIN pitch.

Figure 4:
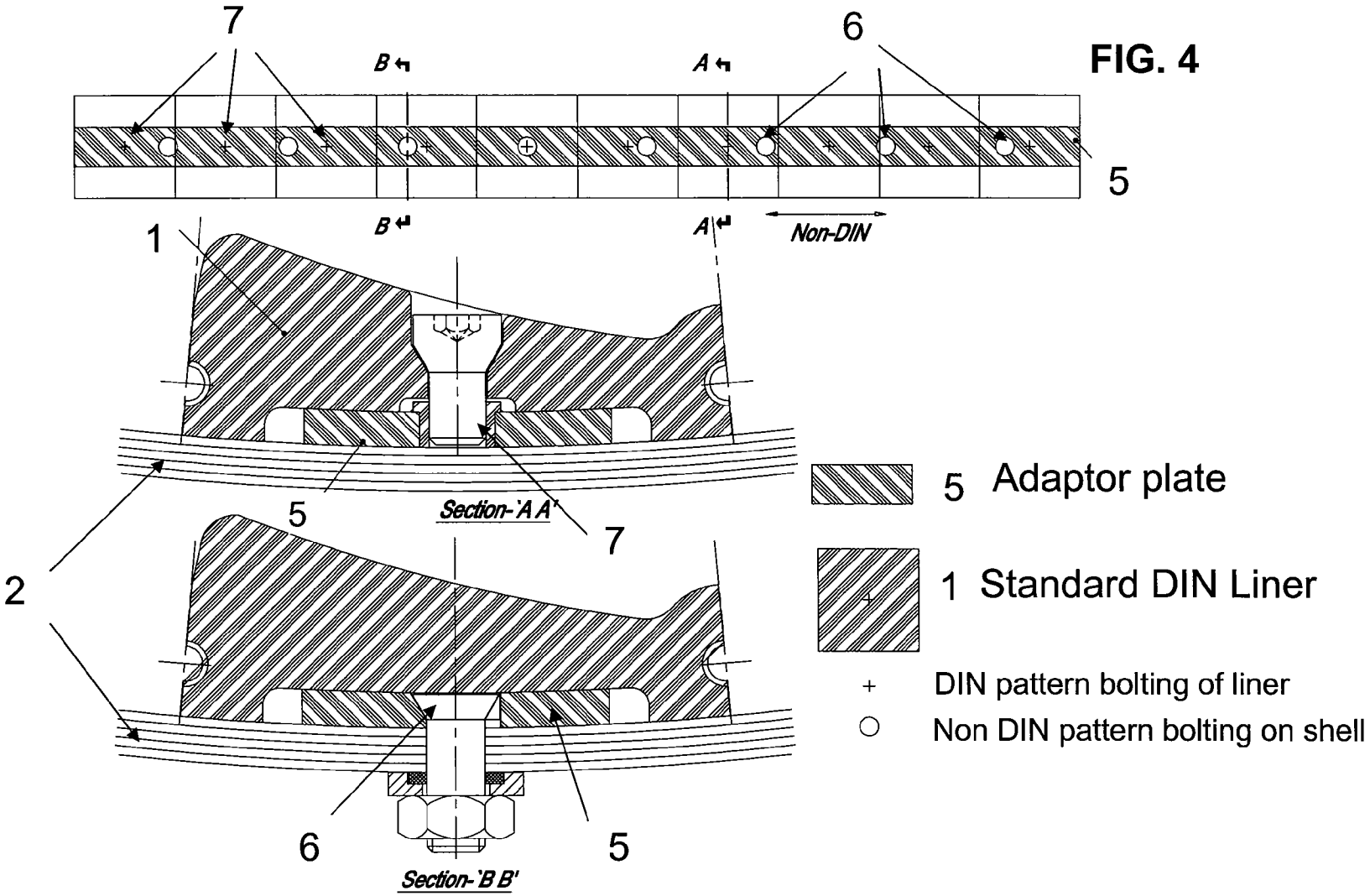
FIG. 4 illustrates the installation of one bolted row of DIN liners (1) in a tube mill shell (2) having non DIN drilling, using the adaptor plate (5).

Bolted liners are installed on the adaptor plates as shown in FIG. 4. FIG. 4 shows a cross section at one foot pitch (i.e. non-DIN) and cross section at 250 mm pitch (DIN). A mill may require either two or more such rows in a longitudinal direction (two rows at 180 degrees, three rows at 120 degrees, etc.) in order to support the boltless liners between these bolted rows.

After two or more such bolted rows in longitudinal direction and first and last bolted rows have been installed, installation of boltless liners can proceed.

An example of one embodiment is illustrated in FIG. 4, which shows liners with a step profile. However, it is understood that the present invention is valid for liners of any profiles installed in tube mills.

Examples

In one 3.048 M diameter mill, the longitudinal pitch is 380 mm. In this mill boltless liners as per DIN standard design were installed using an adaptor plate with a pattern of holes with a longitudinal non-DIN pitch of 380 mm and a pattern of threaded holes with a DIN pitch of 250 mm as illustrated above. The mill, installed for the purpose of reasonable trial and experimentation, completed 1000 hours of operation and continues to run satisfactorily with normal output till date.

Another 3.4 M diameter mill with a longitudinal pitch of 378 mm was fitted with boltless liners using an adaptor plate with a pattern of holes with a longitudinal non-DIN pitch of 378 mm and a pattern of threaded holes with a DIN pitch of 250 mm as illustrated above. The mill installed for the purpose of reasonable trial and experimentation completed 1000 hours of operation and continues to run satisfactorily with normal output till date.

While the invention has been described by way of example and in terms of the specific embodiments, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A tube mill provided with liners fastened to a shell, wherein the tube mill is provided with an adaptor plate, the adaptor plate being provided with a first pattern of drilling holes in a DIN pattern and a second pattern of drilling holes in a non-DIN pattern wherein the adaptor plate is fastened to the shell via one or more of the holes of the second pattern and a number of liners is fastened to the adaptor plate only via one or more holes of the first pattern.

2. A method for installing liners in a tube mill wherein an adaptor plate provided with a first pattern of drilling holes in a DIN pattern and a second pattern of drilling holes in a non-DIN pattern, liners are attached to the adaptor plate only via the holes of the first pattern and the adaptor plate is attached to the shell via one or more holes of the second pattern.

3. A method as claimed in claim 2, wherein after fixing of at least two rows of bolted liners, rows of boltless liners are installed.

4. A method for installing a plurality of liners in a tube mill, the method comprising:

providing an adaptor plate having a first pattern of drilling holes in a DIN pattern and a second pattern of drilling holes in a non-DIN pattern;

attaching liners to the adapter plate only via the holes of the first pattern; and attaching the adaptor plate to a shell via one or more holes of the second pattern.

5. A method for installing liners in a tube mill having a shell, the method comprising:

providing a plurality of adaptor plates with a first pattern of drilling holes in a DIN pattern and a second pattern of drilling holes in a non-DIN pattern;

attaching the adapter plates to the shell via the second pattern of holes in the non-DIN pattern;

attaching a plurality of liners to the adaptor plates via one or more holes in the first pattern of holes in the DIN pattern without being directly attached to the shell.

6. The method of claim 5 wherein the holes in the first pattern of holes in the DIN pattern are threaded.

7. The method of claim 6 wherein attaching a plurality of liners to the adaptor plates comprises attaching the liners with screws into the threaded holes.

8. The method of claim 7 wherein the tube mill has a circumferential direction, a longitudinal direction, a first end and a second end, wherein the plurality of liners comprises bolted liners and unbolted liners, and wherein attaching the liners in rows comprises:

attaching at least one row of bolted liners in the circumferential direction at the first end;

attaching at least one row of bolted liners in the circumferential direction at the second end; and attaching at least one row of bolted liners in the longitudinal direction.

9. The method of claim 7 wherein attaching the liners in rows further comprises installing at least one row of boltless liners in between the rows of bolted liners, wherein the bolted liners support the boltless liners.

10. The method of claim 5 wherein attaching the liners to the adaptor plates comprises attaching the liners in rows in alignment with the second pattern.

11. The method of claim 10 wherein attaching the liners to the adaptor plates comprises attaching the liners in rows in alignment with the second pattern.

12. A tube mill comprising:

a shell comprising:

a first end;

a second end;

a circumference direction; and a longitudinal direction;

a plurality of adaptor plates comprising:

a first pattern of holes in a DIN pattern and a second pattern of holes in a non-DIN pattern and attached to the shell via the second pattern of holes; and a plurality of liners attached to the adaptor plates only, via the holes of the first pattern.

13. The tube mill of claim 12 wherein the holes in the first pattern of holes in the DIN pattern are threaded.

14. The tube mill of claim 13 wherein plurality of liners are attached to the adaptor plates only using screws threaded into the threaded holes in the first pattern of holes in the DIN pattern.

* * * * *